US008210308B2

(12) United States Patent
Penner et al.

(10) Patent No.: US 8,210,308 B2
(45) Date of Patent: Jul. 3, 2012

(54) SOUND ATTENTUATOR

(75) Inventors: Jarvis M. Penner, Winnipeg (CA); Alfred Theodor Dyck, Winnipeg (CA); Brad Curtis Tully, Winnipeg (CA); Bogna Gryc, East St. Paul (CA)

(73) Assignee: E.H. Price Ltd., Winnippeg (CA)

( * ) Notice: Subject to any disclaimer, the term of this patent is extended or adjusted under 35 U.S.C. 154(b) by 0 days.

(21) Appl. No.: 12/896,023

(22) Filed: Oct. 1, 2010

(65) Prior Publication Data

US 2011/0061967 A1 Mar. 17, 2011

Related U.S. Application Data

(63) Continuation-in-part of application No. 12/047,816, filed on Mar. 13, 2008, now Pat. No. 7,806,229.

(60) Provisional application No. 60/895,152, filed on Mar. 16, 2007.

(51) Int. Cl.
*E04F 17/04* (2006.01)

(52) U.S. Cl. ..... 181/224; 181/225; 454/338

(58) Field of Classification Search ..... 181/224, 181/225; 454/338
See application file for complete search history.

(56) References Cited

U.S. PATENT DOCUMENTS

| | | | |
|---|---|---|---|
| 2,950,776 | A | 8/1960 | Stephens |
| 3,018,840 | A | 1/1962 | Bourne et al. |
| 3,033,307 | A | 5/1962 | Sanders et al. |
| 3,507,356 | A | 4/1970 | Smith |
| 3,511,336 | A | 5/1970 | Rink et al. |
| 3,568,791 | A | 3/1971 | Luxton |
| 3,642,093 | A | 2/1972 | Schach |
| 3,841,434 | A | 10/1974 | Culpepper, Jr. |
| 4,236,597 | A | 12/1980 | Kiss et al. |
| 4,287,962 | A | 9/1981 | Ingard et al. |
| 4,905,479 | A | 3/1990 | Wilkinson |
| 4,955,205 | A | 9/1990 | Wilkinson |
| 4,959,970 | A | 10/1990 | Meckler |
| 5,728,979 | A | 3/1998 | Yazici et al. |
| 5,869,792 | A | 2/1999 | Allen et al. |
| 5,983,888 | A | 11/1999 | Anselmino et al. |
| 6,342,005 | B1 | 1/2002 | Daniels et al. |
| 6,402,612 | B2 | 6/2002 | Akhtar et al. |
| 6,419,576 | B1 | 7/2002 | Han |
| 6,640,926 | B2 | 11/2003 | Weinstein |
| 6,802,690 | B2 | 10/2004 | Han et al. |

FOREIGN PATENT DOCUMENTS

| | | |
|---|---|---|
| DE | 3401210 A1 | 7/1985 |
| GB | 984817 | 3/1965 |

*Primary Examiner* — Forrest M Phillips
(74) *Attorney, Agent, or Firm* — Hahn Loeser & Parks LLP

(57) ABSTRACT

An apparatus and method for attenuating the sound generated by a fan powered terminal unit or other equipment in an HVAC (heating, ventilating, and air conditioning) system is described. The apparatus utilizes internal geometry to minimize noise due to air disturbances and aerodynamic effects within the apparatus. Specifically, a silencer is described comprising a casing having an inlet and an outlet; a condensate deflector positioned at the inlet to the casing; at least one baffle being operable to attenuate noise in a gas flowing through the silencer; and an air pathway through the silencer, defined by positions of the condensate deflector and the at least one baffle within the casing. The air pathway is angled or curved to substantially minimize the line-of-sight pathway from the inlet to the outlet.

20 Claims, 11 Drawing Sheets

100
101
102
103
104
105
106
107
108
109
110
305
351
352
353
354

206
203a
202
209
204
207
201
208
206
203b
202
204
209
210
205
207
201

403
402
405

4C
4C 4D
404
407
409
4D
408
402
406
401
401

5C
5C
5D
5D
503
505
504
502
501
501

407
505
451
452
453
454
551
552
553
554

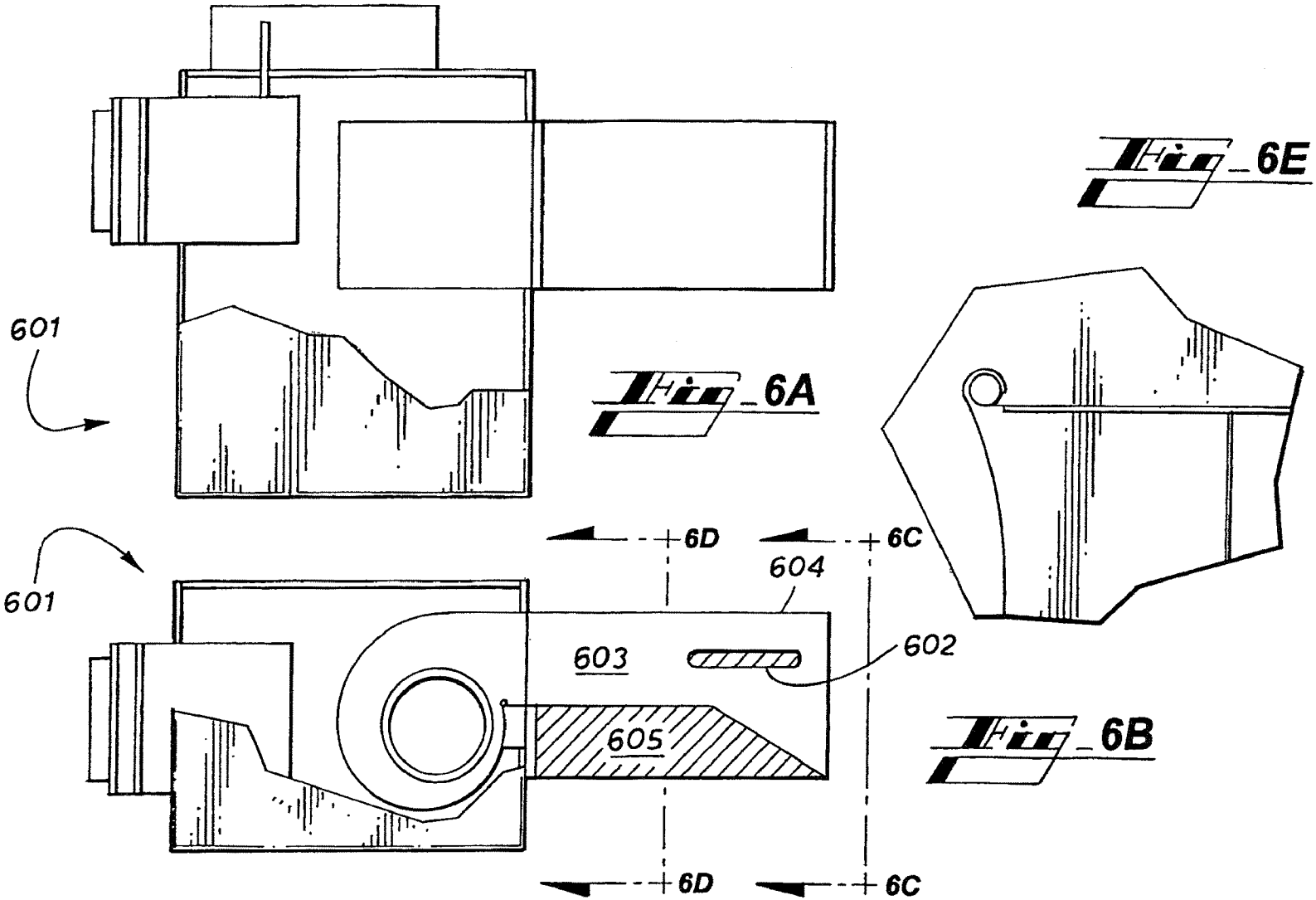
601
601
6A
6B
6E
6C
6C
6D
6D
602
603
604
605

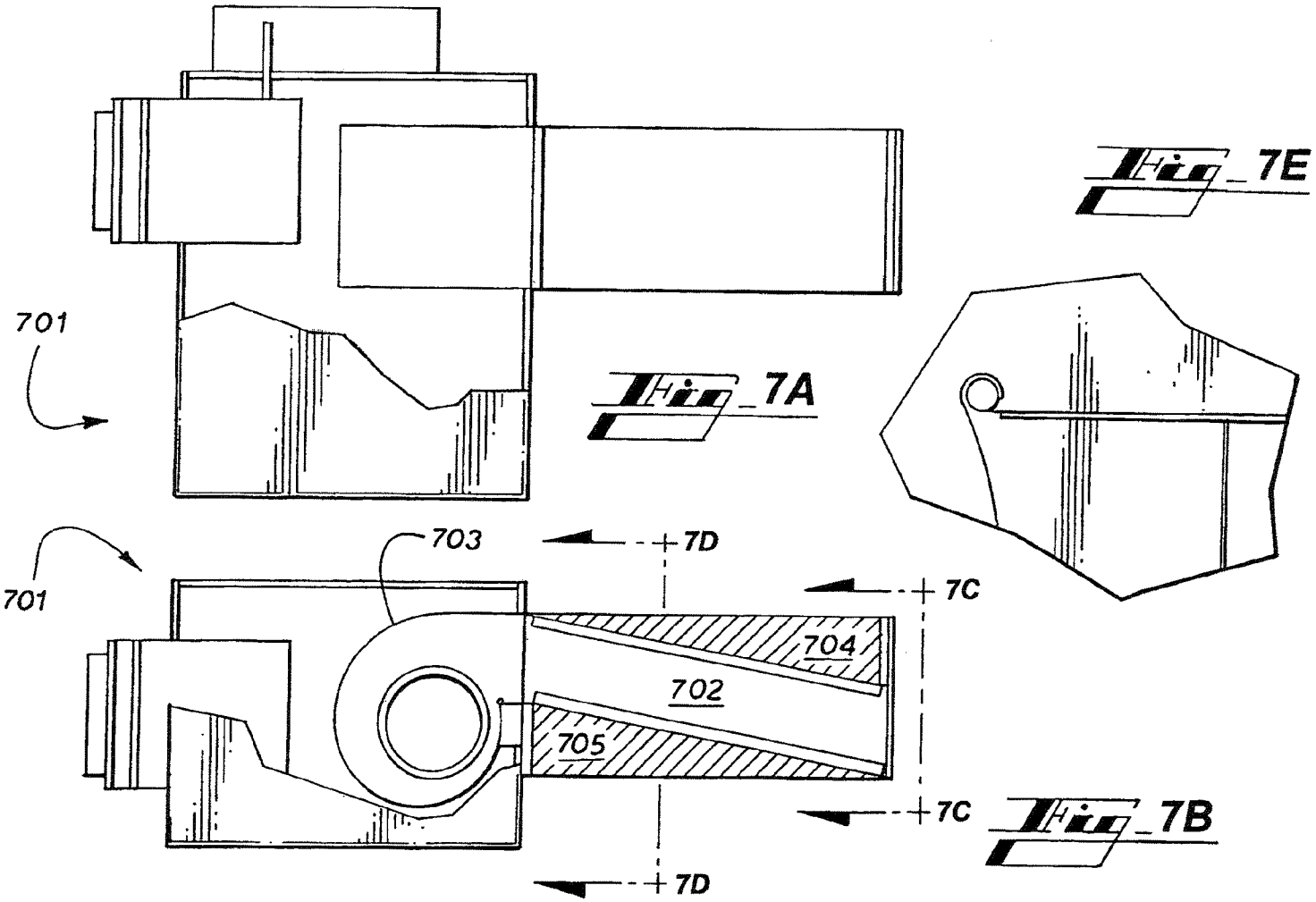
7E
7A
7B
7C
7C
7D
7D
704
702
705
703
701
701

SOUND ATTENTUATOR

CROSS REFERENCES TO RELATED APPLICATIONS

This application is a continuation-in-part application based on U.S. application Ser. No. 12/047,816, filed Mar. 13, 2008, which claims priority to U.S. provisional application No. 60/895,152, filed Mar. 16, 2007, both of which are incorporated herein by reference.

FIELD OF INVENTION

This invention relates to a silencing unit for HVAC (heating, ventilating, and air conditioning) systems, and more particularly, to a silencer with an integral condensation plate.

BACKGROUND OF THE INVENTION

Commercial HVAC systems may have a contained "Fan Coil" ("FC") for the purpose of providing an outlet for commercial ventilation systems into the rooms of a building or other structure equipped with an HVAC system. An FC typically consists of the following components: 1) centrifugal fan, 2) motor, 3) insulated casing, 4) air inlet (with or without damper), and 5) Heating/Cooling Coils.

In commercial HVAC installations, a "silencer" (or "attenuator") is often attached to the inlet or outlet of an FC in order to attenuate the sound produced by the high-velocity air entering the FC. Such silencers have typically comprised an air duct (typically from three to five feet in length) that is lined internally with insulation to attenuate the noise produced by the air flowing through the FC. Such internal insulation is also known as a "baffle" and is usually held in place by perforated sheet metal. The perforations in the metal allow the air traveling through the silencer to interact with the insulation material contained inside the baffle. The silencer is attached to the inlet or the outlet of the FC and acts to attenuate the noise that is produced by the FC. This attenuation is achieved due to the conversion of acoustic energy into heat energy as the air molecules inside the silencer create friction when they collide with the lined insulation.

The noise generated by an FC or other HVAC component can be separated into two components: 1) noise due to the air disturbance created in the immediate vicinity of the rotating fan blades and 2) aerodynamic noise due to the fan-induced air flow that has variable pressure regions within the fan discharge velocity profile and the air flow interaction with geometry changes in the air stream. The insulation contained in silencers is typically designed to minimize both sources of noise.

There is a need for an improved silencer, particularly one which is compact, efficient and durable.

Fan Coil units are capable of producing condensate carryover when applied in higher humidity conditions. This design helps prevent carryover as an integral part of the unit.

SUMMARY OF THE INVENTION

It is an object of the invention to provide an improved silencer.

The exemplary system described herein (a fan coil quiet unit "FCQ") includes an apparatus and method for attenuating the sound generated by a fan coil unit or other HVAC equipment.

Embodiments of the invention can minimize the noise generated by the variable pressure regions within the FCQ unit by closely coupling the noise-attenuating, insulation-lined silencing portion of the unit to the housing of the centrifugal fan inside the unit. Such close-coupling minimizes the turbulence created by the centrifugal fan and thus minimizes the associated noise.

Embodiments of the invention also minimize noise within the FCQ by creating a constant, uniform cross-sectional profile of the air traveling through the unit. This uniform cross-sectional profile minimizes the turbulence created when air exiting a typical FC enters a silencer with a larger (or smaller) cross-sectional area. The decreased turbulence in the airflow of the invention, in turn, helps minimize the noise generated by the FCQ.

Embodiments of the invention minimize high-frequency noise due to the internal angled or curved geometry of the FCQ. Such geometry obstructs any direct line-of-sight pathway out of the unit that would otherwise allow high-frequency noise to escape without much attenuation. Traditional silencers lack any such internal geometry and instead allow high-frequency noise to exit the silencer without contacting the baffles of the silencer. Therefore, the high-frequency noise in a traditional silencer can escape without much attenuation.

This silencer is described as comprising a casing having an inlet and an outlet; a condensate deflector positioned at the inlet to the casing; at least one baffle being operable to attenuate noise in a gas flowing through the silencer; and an air pathway through the silencer, defined by positions of the condensate deflector and the at least one baffle within the casing. The air pathway is angled or curved to substantially minimize the line-of-sight pathway from the inlet to the outlet. The condensate deflector may also have a leading edge at the inlet to the casing and a trailing edge fixed to a leading edge of the baffle, the trailing edge of the baffle being fixed to the outlet of the casing.

Further objects, features, and advantages will become apparent upon consideration of the following detailed description of the invention when taken in conjunction with the drawings and the appended claims.

BRIEF DESCRIPTION OF THE DRAWINGS

FIG. 6A is a top cut away view of an embodiment of an FCQ in accordance with the invention.

FIG. 6B is a side cross-sectional view of FIG. 6A.

FIG. 6E is a magnified cross-sectional view of inset 6E of FIG. 6B.

FIG. 7A is a top cut away view of an embodiment of an FCQ in accordance with the invention.

FIG. 7B is a side cross-sectional view of FIG. 7A.

FIG. 7E is a magnified cross-sectional view of inset 7E of FIG. 7B.

DETAILED DESCRIPTION

Figures 1, 3C, 3D:
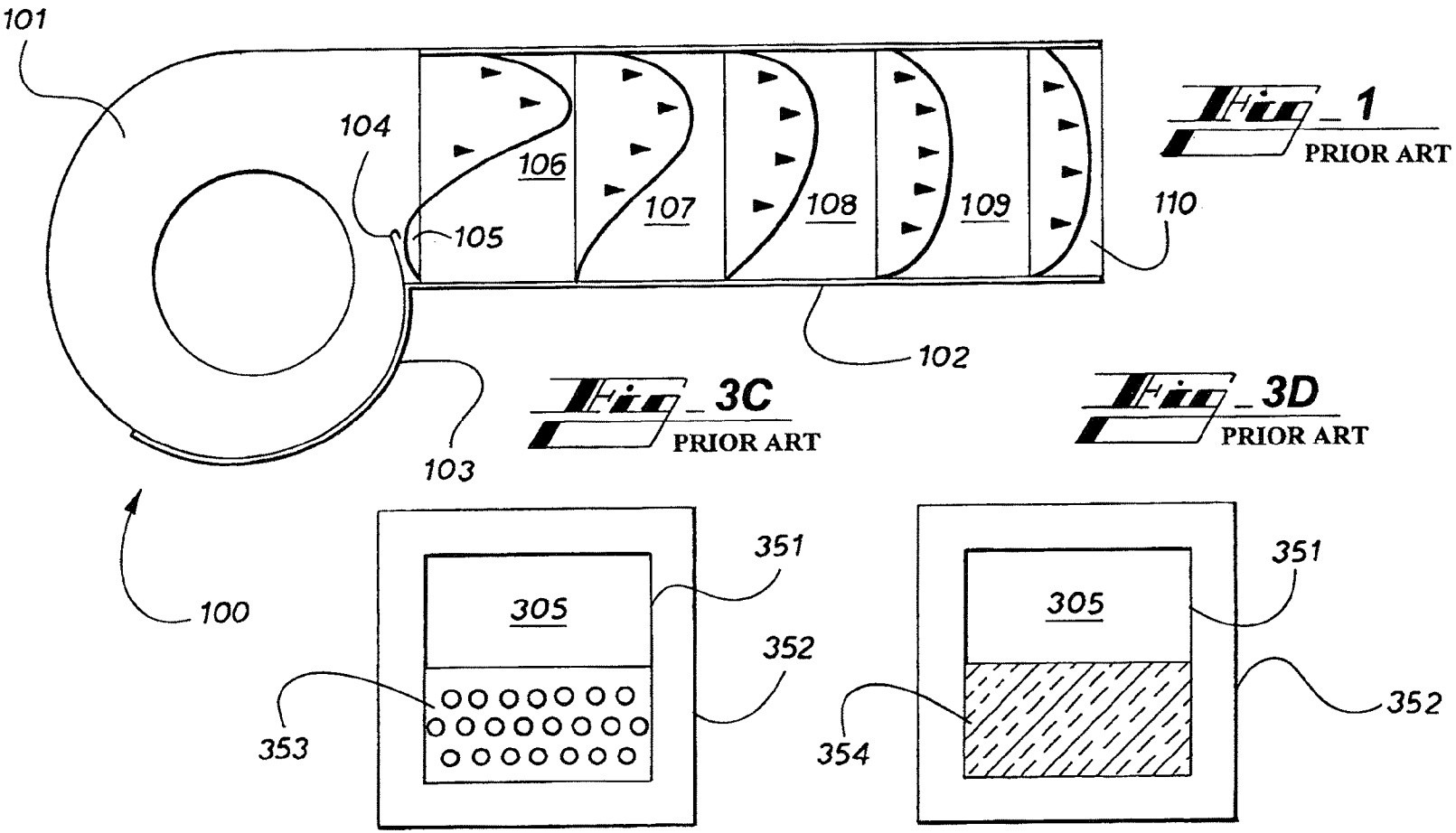
Fig. 1 PRIOR ART
Fig. 3C PRIOR ART
Fig. 3D PRIOR ART
FIG. 1 is a side elevation view of a centrifugal fan and the velocity and pressure profile of the air leaving the centrifugal fan in a prior art FC.
FIG. 3C is an end view along line 3C of FIG. 3B.
FIG. 3D is a cross-sectional view along line 3D of FIG. 3B.

FIG. 1 is an illustration of the velocity and pressure profile of a centrifugal fan 101 in a typical prior art FC 100. The centrifugal fan 101 is enclosed in a housing 103 and blows air out into a discharge duct 102 or attached silencer. The housing 103 of the fan 101 has a cutoff plate 104 on the lower edge of the housing 103. The cutoff plate 104 creates a low pressure area 105 immediately behind the cutoff plate 104. The high-velocity air exiting the fan 101 exhibits a non-uniform bulge 106 of high pressure. As the air travels down the discharge duct 102, the bulge of high pressure will gradually even out as illustrated in 107, 108, 109, and 110. The turbulence generated as the high pressure bulge gradually evens out will create noise in the FC 100.

Figures 2A, 2B:
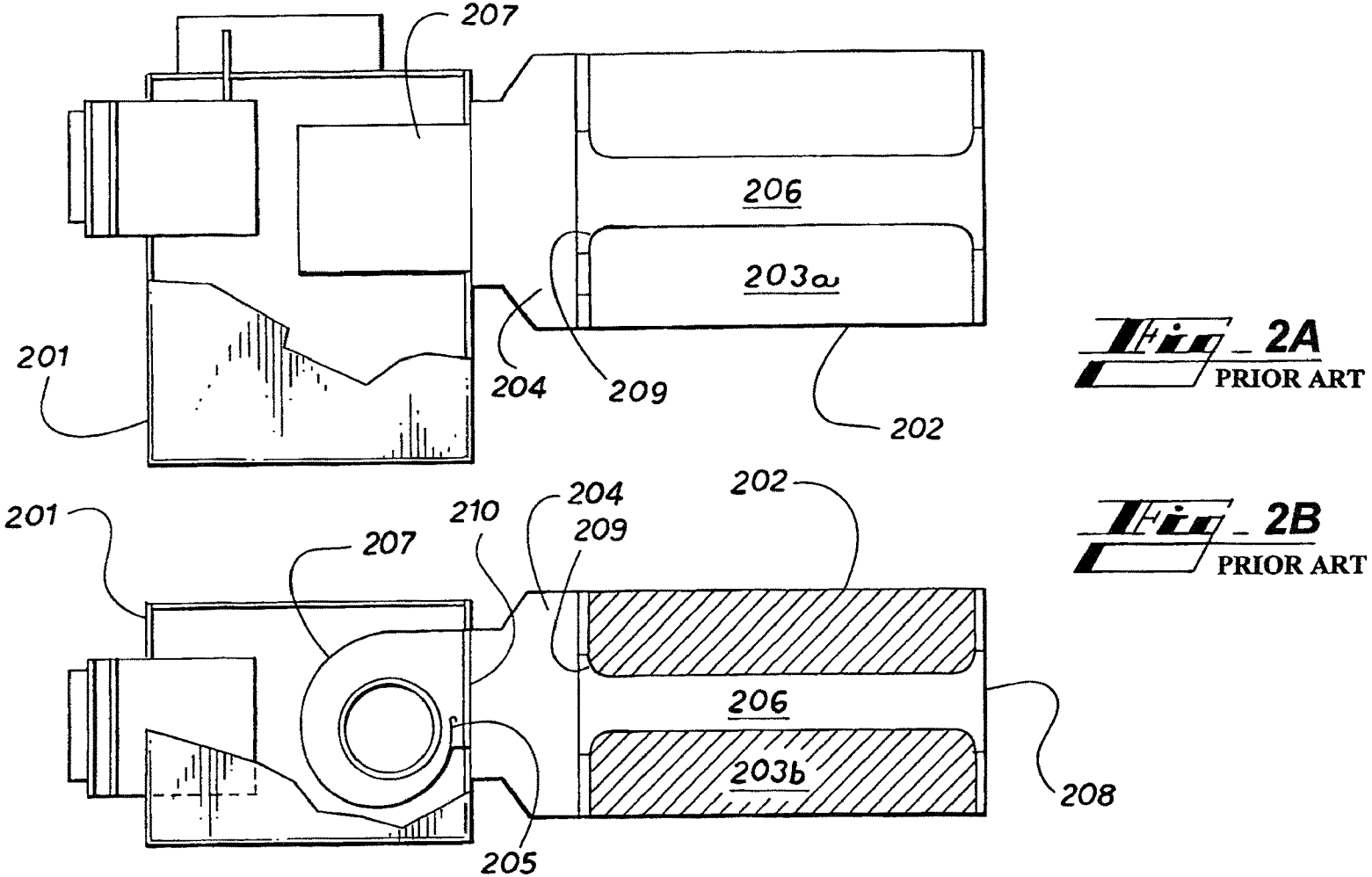
Fig. 2A PRIOR ART
Fig. 2B PRIOR ART
FIG. 2A is a top cut away view of a prior art FC coupled to a prior art silencer with vertical baffles.
FIG. 2B is a side cross-sectional view of a prior art FC coupled to a prior art silencer with horizontal baffles.

FIGS. 2A and 2B are illustrations of the close-coupling of a prior art FC 201 with a prior art silencer 202. Such silencers typically have vertical baffles 203*a* or horizontal baffles 203*b* (with respect to the FC 201) in order to attenuate the sound produced by the FC 201. Prior art silencers 202 typically have a wider cross-sectional area than a corresponding FC 201, creating a wide area 204 inside the silencer 202. This wide area 204 creates a space where turbulence can develop in the silencer 202, thus unnecessarily increasing the noise level in the silencer 202. In addition, prior art FCs 201 contain the cutoff plate 205 described previously, which also increases the noise generated by the FC 201 due to the non-uniform bulge of high pressure exiting the FC 201. The cross-sectional area of the blower outlet 210 of prior art FCs 201 is typically larger than the cross-sectional area of the air pathway 206 of prior art silencers 202. Therefore a "nose" 209 is created where the air exiting the blower outlet 210 collides into the baffles 203*a*, 203*b* inside the silencer 202. This causes added turbulence and increased noise.

Prior art FCs 201 and silencers 202 also have a direct line-of-sight pathway 206 from the centrifugal fan 207 of the FC 201 to the discharge outlet 208 of the silencer 202. As a consequence of such a direct line-of-sight pathway 206, high-frequency sounds can travel relatively unobstructed through the silencer 202. This is because the shorter wavelengths of high-frequency sound waves produce less displacement of the air molecules and hence those air molecules are less likely to collide with the baffles 203*a*, 203*b* inside the silencer 202. This "beaming" effect of high-frequency sounds thus reduces the effectiveness of prior art silencers 202 in reducing high-frequency noise.

FIGS. 3A-3D are depictions of a prior art FC 301 closely-coupled to a prior art silencer 304 with only a half-baffle design. That is, the silencer 304 contains a baffle 306 on only a single internal wall. This half-baffle silencer 304 still contains a nose 302 which leads to increased turbulence and noise. The nose 302 is caused because the cross-sectional air pathway 305 of the silencer 304 is narrower than the cross-sectional area of the blower outlet 303 of the FC 301.

FIG. 3C depicts an end view of the silencer 304 and the perforated metal casing 353 that encloses the insulating material 354 of the baffle 306. FIG. 3C also shows the casing 351 of the silencer 304 and the casing 352 of the FC 301.

FIG. 3D depicts a cross-sectional view of the insulating material 354 that comprises the baffle 306 of the silencer 304. FIG. 3D also shows the casing 351 of the silencer 304 and the casing 352 of the FC 301.

FIGS. 4A-4E depict an embodiment of an FCQ 401 in accordance with the invention. FCQ 401 contains a silencer inlet extension 402 which connects the top edge 403 of the baffle 409 contained in the silencing portion 404 of the FCQ 401 directly to the cutoff plate 405 of the centrifugal fan 406 housed in the FCQ 401. The silencer inlet extension 402 eliminates the low-pressure area 105 caused by the cutoff plate 104 in prior art FCs (FIG. 1). Therefore, the air exiting the centrifugal fan 406 does not contain a non-uniform bulge of high pressure as it travels down the air pathway 407 of the silencing portion 404 of the FCQ 401.

Figure 3A:
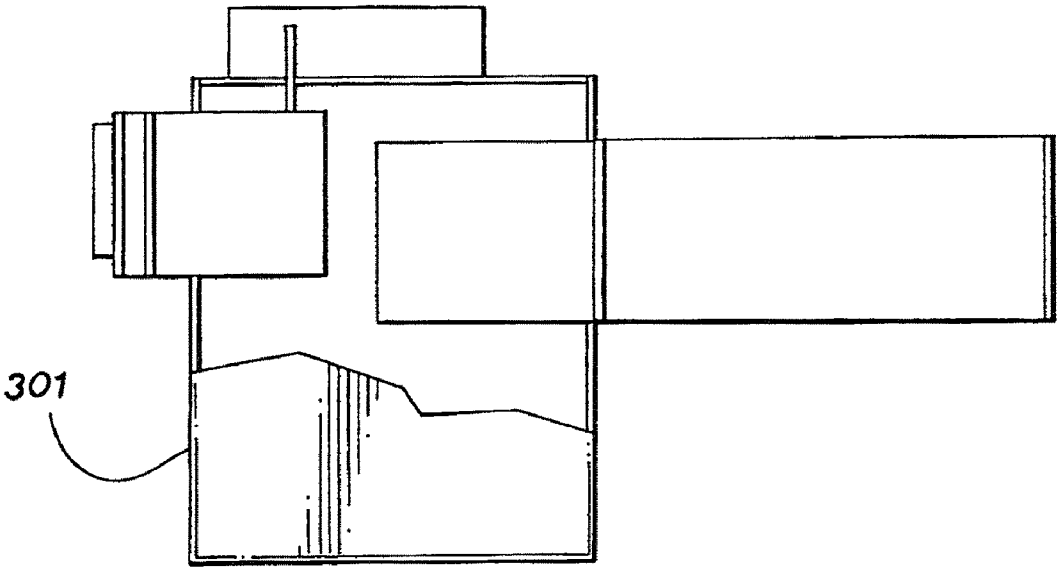
FIG. 3A PRIOR ART
FIG. 3A is a top cut away view of a prior art FC coupled to a prior art silencer.
Figure 3B:
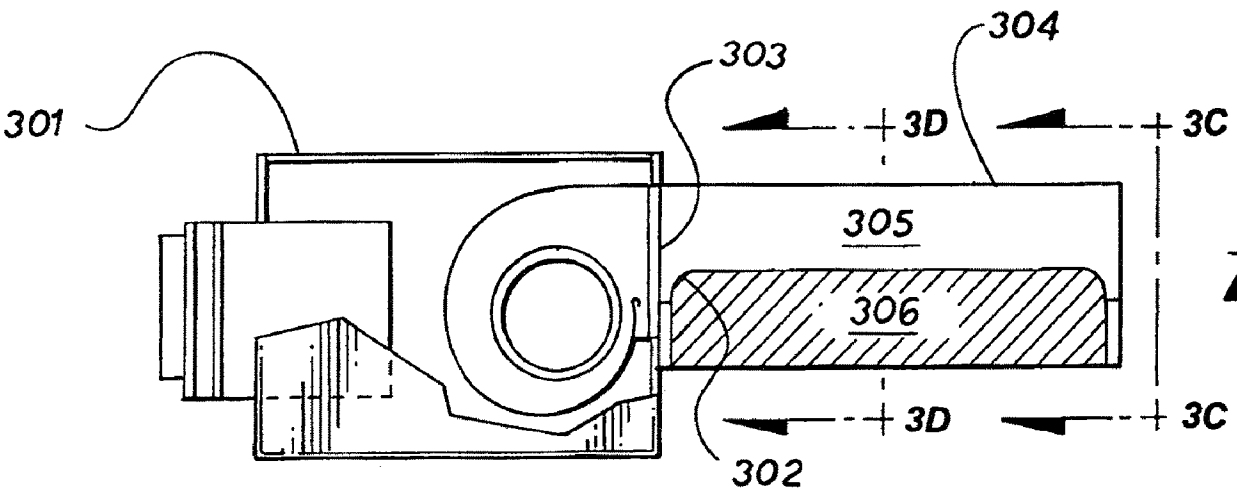
FIG. 3B PRIOR ART
FIG. 3B is a side cross-sectional view of FIG. 3A.
Figures 5A, 5B, 5E:
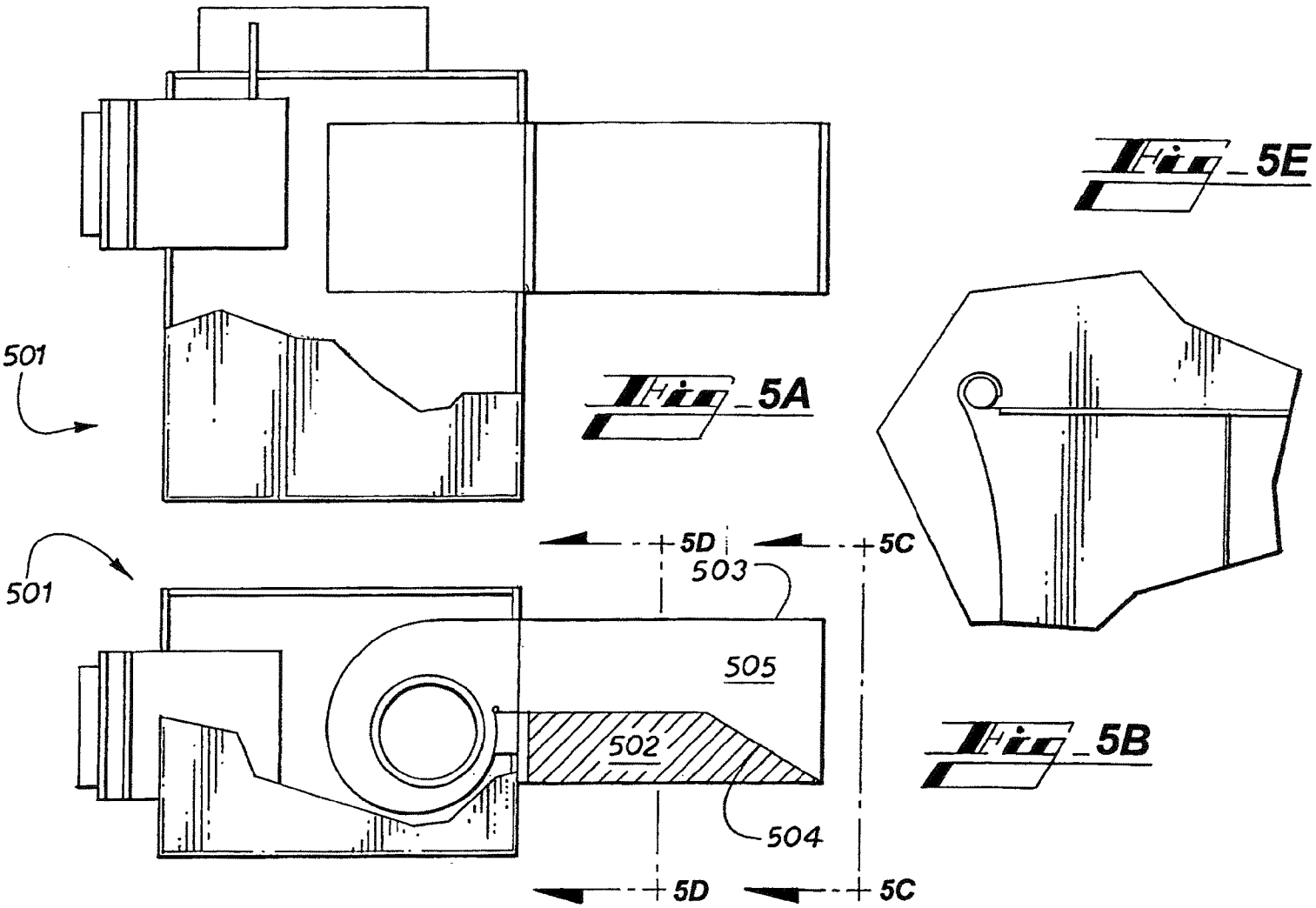
FIG. 5A is a top cut away view of an embodiment of an FCQ in accordance with the invention.
FIG. 5B is a side cross-sectional view of FIG. 5A.
FIG. 5E is a magnified cross-sectional view of inset 5E of FIG. 5B.

In addition, the cross-sectional area of the blower outlet 408 substantially equals the cross-sectional area of the air pathway 407 of the silencing portion 404 of the FCQ 401. Therefore, the FCQ 401 contains no nose, unlike the nose 209, 302 present in prior art silencers 202, 304 (FIGS. 2B, 3B).

Figures 4A, 4B, 4E:
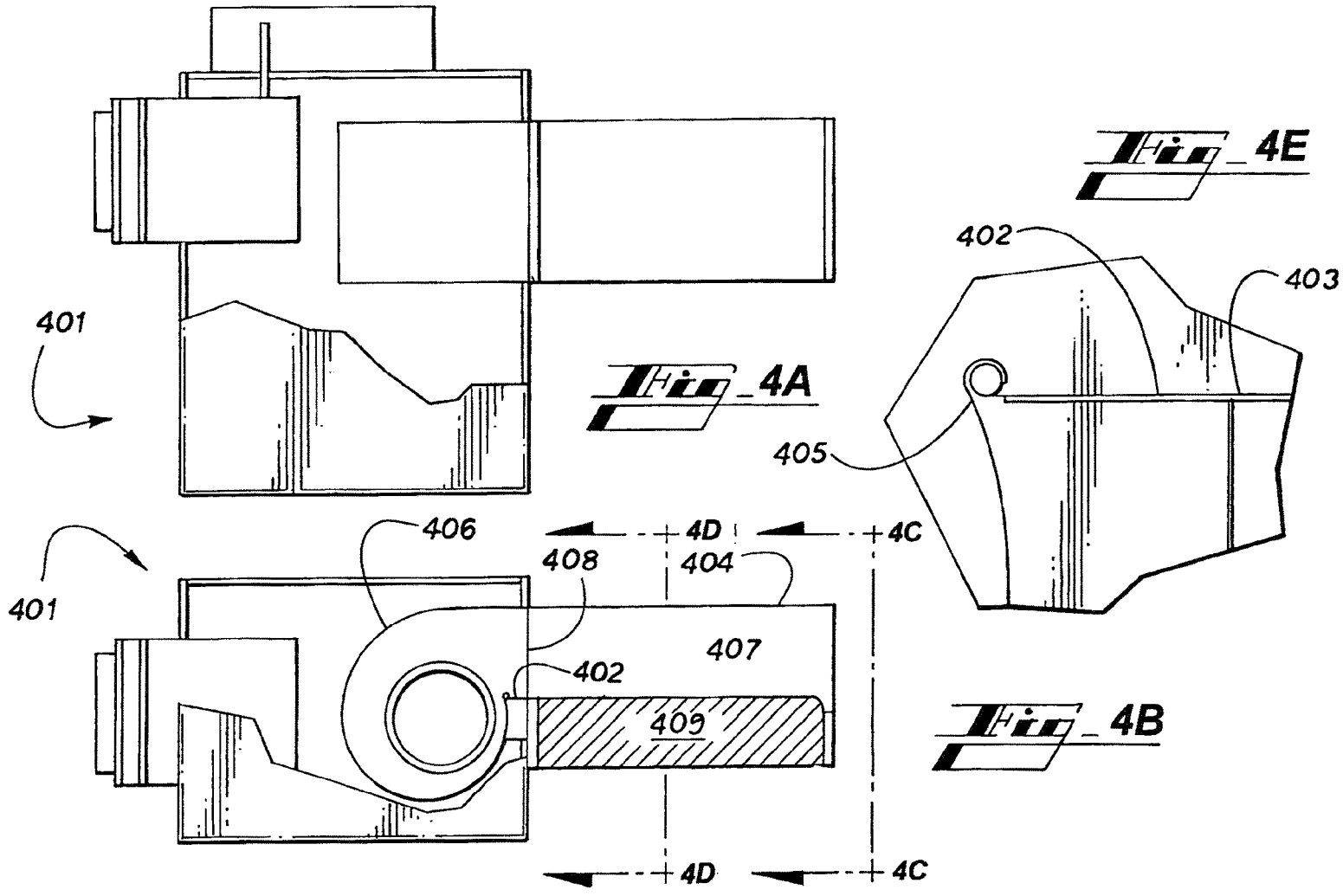
FIG. 4A is a top cut away view of an embodiment of an FCQ in accordance with the invention.
FIG. 4B is a side cross-sectional view of FIG. 4A.
FIG. 4E is a magnified cross-sectional view of inset 4E of FIG. 4B.
Figures 4C, 4D, 5C, 5D:
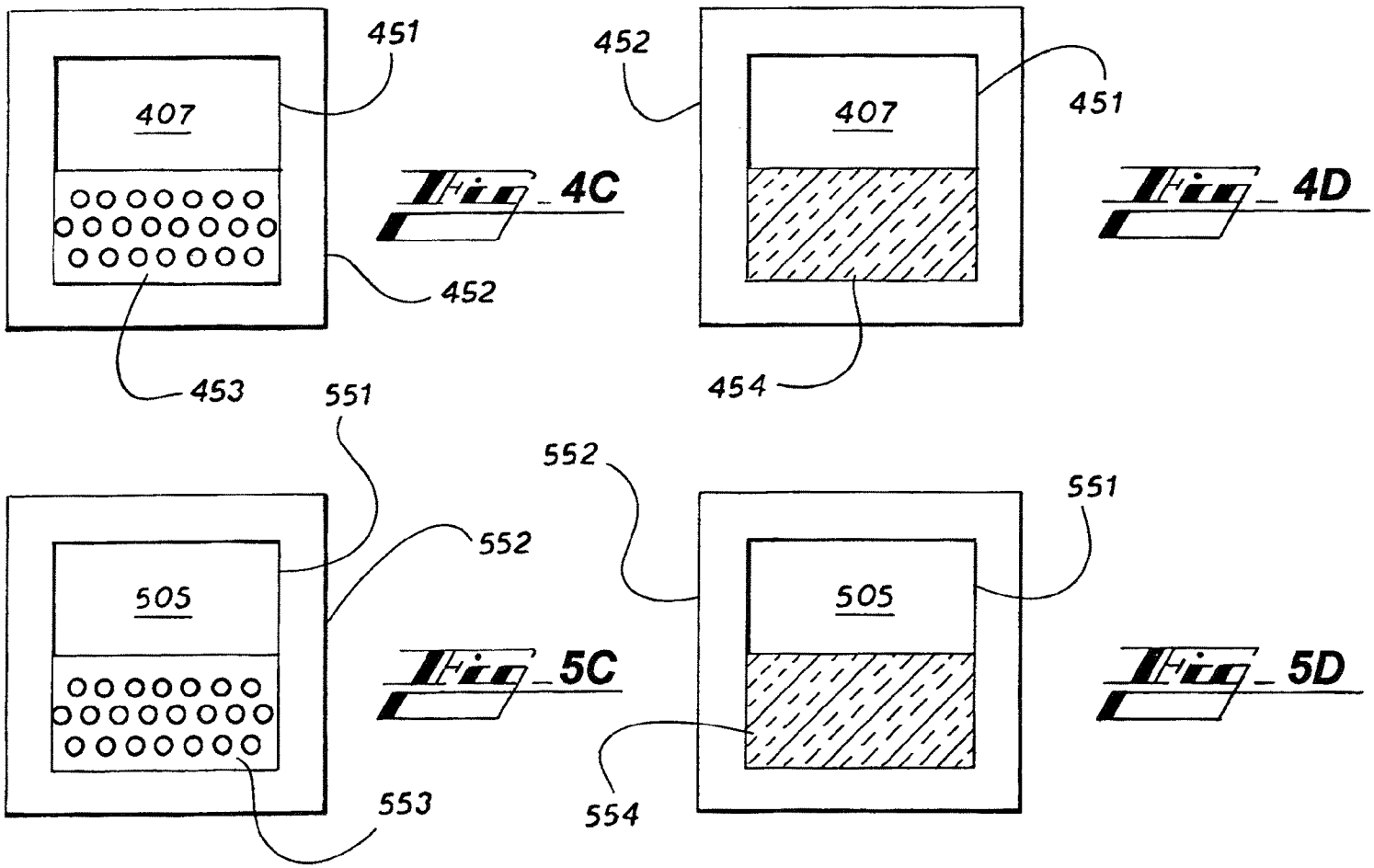
FIG. 4C is an end view along line 4C of FIG. 4B.
FIG. 4D is a cross-sectional view along line 4D of FIG. 4B.
FIG. 5C is an end view along line 5C of FIG. 5B.
FIG. 5D is a cross-sectional view along line 5D of FIG. 5B.

FIG. 4C depicts an end view of the FCQ 401 and the perforated metal casing 453 that encloses the insulating material 454 of the baffle 409. FIG. 4C also shows the casing 451 of the silencing portion 404 of the FCQ 401 and the casing 452 of the plenum portion of the FCQ 401.

FIG. 4D depicts a cross-sectional view of the insulating material 454 that comprises the baffle 409 of the silencing portion 404 of the FCQ 401. FIG. 4D also shows the casing 451 of the silencing portion 404 of the FCQ 401 and the casing 452 of the plenum portion of the FCQ 401.

FIGS. 5A-5E illustrate an embodiment of the invention wherein the baffle 502 of the silencing portion 503 of the FCQ 501 flares outward in a "tail" 504. This tail 504 allows the expanding air that is traveling down the air pathway 505 to maintain a constant pressure. This is because the increased cross-sectional area of the tail portion 504 of the FCQ 501 provides additional space for the expanding air to occupy, thus preventing a buildup of pressure within the FCQ 501.

FIG. 5C depicts an end view of the FCQ 501 and the perforated metal casing 553 that encloses the insulating material 554 of the baffle 502. FIG. 5C also shows the casing 551 of the silencing portion 503 of the FCQ 501 and the casing 552 of the plenum portion of the FCQ 501.

FIG. 5D depicts a cross-sectional view of the insulating material 554 that comprises the baffle 502 of the silencing portion 503 of the FCQ 501. FIG. 5D also shows the casing 551 of the silencing portion 503 of the FCQ 501 and the casing 552 of the plenum portion of the FCQ 501.

FIGS. 6A-6E illustrate an embodiment of the invention with a high-frequency splitter 602 placed in the air pathway 603 of the FCQ 601. The high-frequency splitter 602 scatters high-frequency sound waves that would otherwise pass relatively unobstructed through the air pathway 603 due to the "beaming" effect of high-frequency sound. The scattered high-frequency sound waves will therefore tend to impact the baffle 605 directly or bounce off the casing 604 and then into the baffle 605, which will attenuate the sound.

Figures 6C, 6D, 7C, 7D:
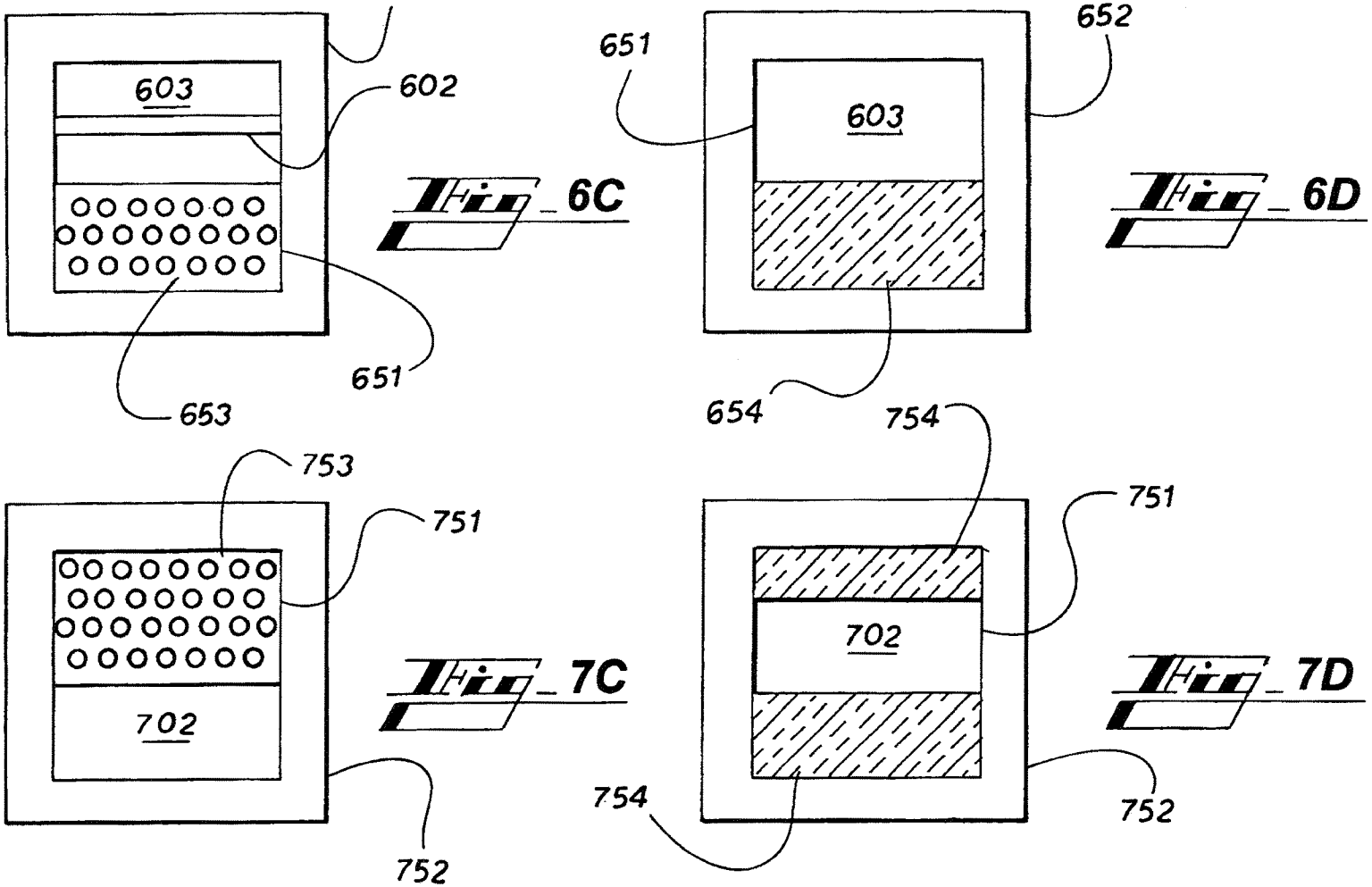
FIG. 6C is an end view along line 6C of FIG. 6B.
FIG. 6D is a cross-sectional view along line 6D of FIG. 6B.
FIG. 7C is an end view along line 7C of FIG. 7B.
FIG. 7D is a cross-sectional view along line 7D of FIG. 7B.

FIG. 6C depicts an end view of the FCQ 601 and the perforated metal casing 653 that encloses the insulating material 654 of the baffle 605. FIG. 6C also shows an end view of the high-frequency splitter 602. FIG. 6C also shows the casing 651 of the silencing portion of the FCQ 601 and the casing 652 of the plenum portion of the FCQ 601.

FIG. 6D depicts a cross-sectional view of the insulating material 654 that comprises the baffle 605 of the silencing portion of the FCQ 601. FIG. 6D also shows the casing 651 of the silencing portion of the FCQ 601 and the casing 652 of the plenum portion of the FCQ 601.

FIGS. 7A-7E depict an embodiment of the invention wherein the air pathway 702 of the FCQ 701 is angled or curved, thus minimizing or eliminating the line-of-sight pathway from the centrifugal fan 703 to the discharge outlet of the FCQ 701. This elimination of the line-of-sight pathway will likewise minimize the high-frequency noise emitted by the centrifugal fan 703 and prevent high-frequency sound waves from traveling down the air pathway 702 unobstructed. The silencing portion of the FCQ 701 can be up to five feet in length, or as little as three feet or less, depending on the application and design parameters.

FIG. 7C depicts an end view of the FCQ 701 and the perforated metal casing 753 that encloses the insulating material 754 of the angled top baffle 704. FIG. 7C also shows the casing 751 of the silencing portion of the FCQ 701 and the casing 752 of the plenum portion of the FCQ 701.

FIG. 7D depicts a cross-sectional view of the insulating material 754 that comprises the top and bottom baffles 704, 705 of the silencing portion of the FCQ 701. FIG. 7D also shows the casing 751 of the silencing portion of the FCQ 701 and the casing 752 of the plenum portion of the FCQ 701.

Figure 8:
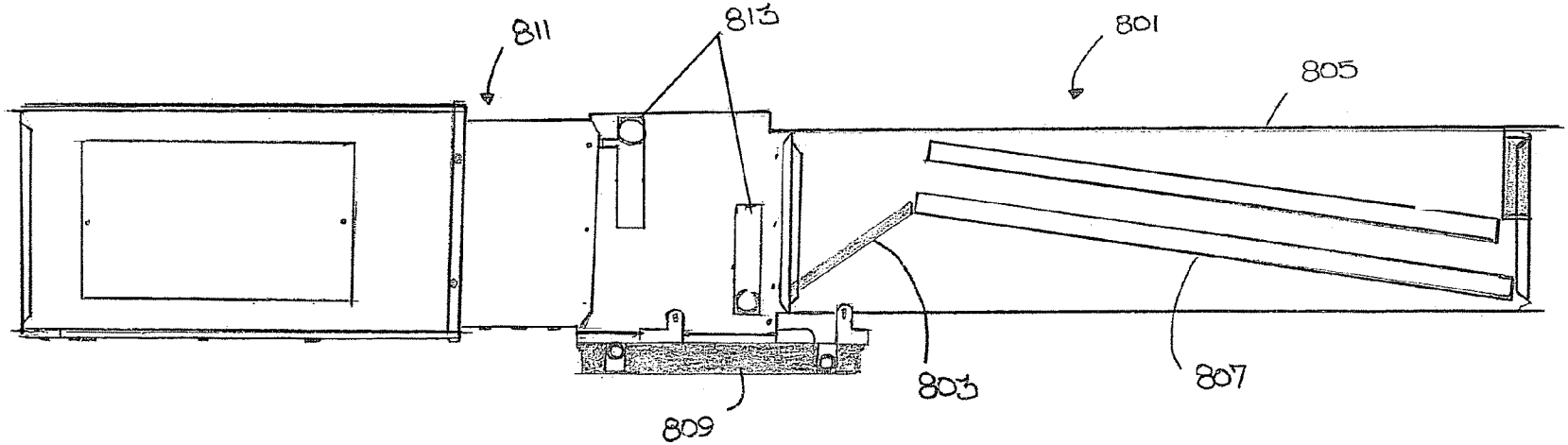
FIG. 8 presents a side cross-sectional view of a silencer with an integrated condensate diverter in accordance with the invention.
Figure 9:
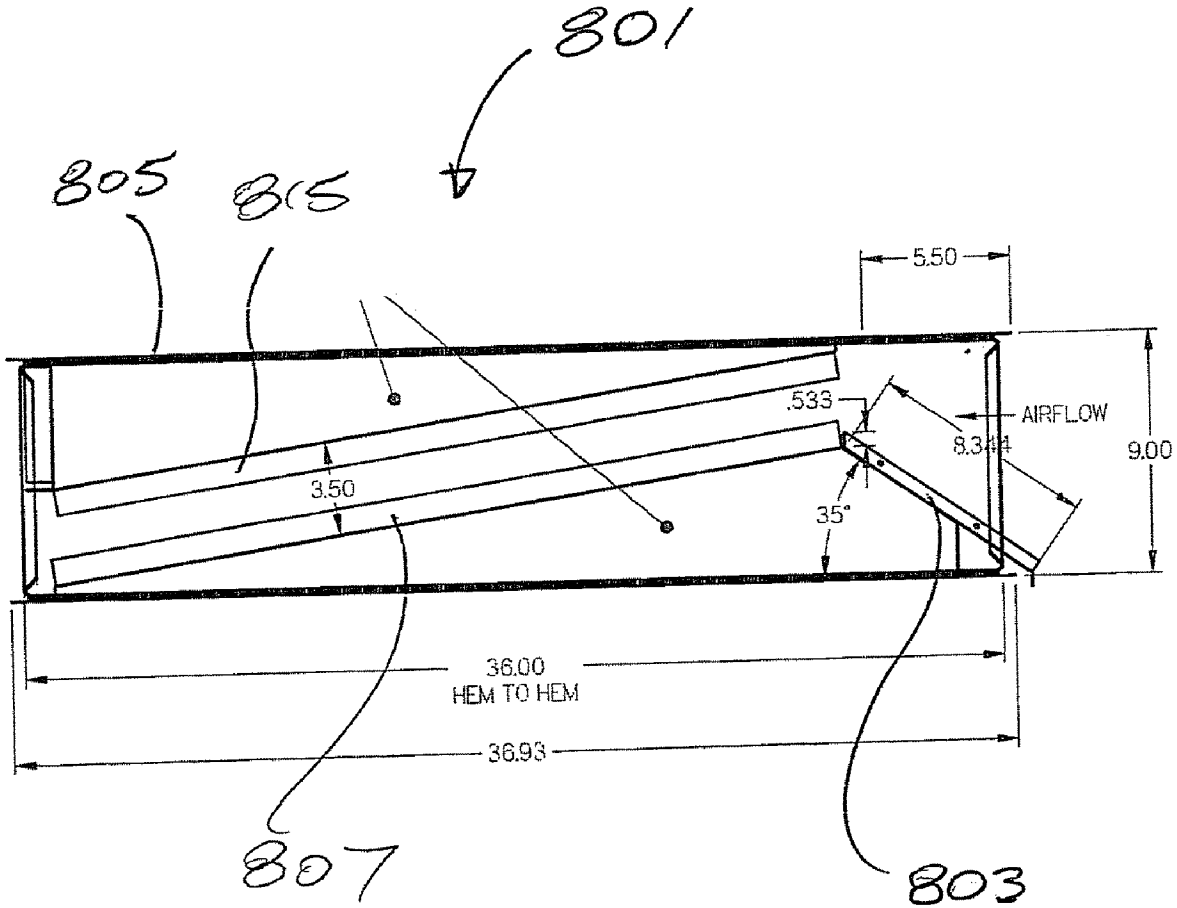
FIG. 9 presents a side cross-sectional view of the silencer of FIG. 8, including dimensions.

FIGS. 8 and 9 depict an additional embodiment of a silencer 801 based on that of FIG. 7, except that it further includes an integrated condensate diverter 803 at the inlet to the silencer 801 rather than a rounded nosing or endplate on the baffle 807. Because the inlet to this silencer 801 has no blunt obstructions, it can efficiently mate with any HVAC component having standard dimensions. It does not have to be designed, for example to mate with the outlet of a single centrifugal fan as shown in FIG. 7B but could mate with a fan coil unit having two or more fans, an axial fan, etc.

The construction details for this silencer 801 will depend on the application and environment in which the system is being installed. For example, in a standard commercial application the casing 805 may be galvanized sheet metal. In such an installation the condensate diverter 803 will typically also be of galvanized sheet metal without perforations, riveted to the silencer walls, the joints being sealed with commercial sealant. The trailing edge of the condensate diverter 803 meets the leading edge of the perforated sheet metal making the lower baffle 807. The condensate diverter 803 may be fastened to the lower baffle 807, but it is generally sufficient to have a folded joint. The trailing edge of the lower baffle 807 terminates adjacent to the outlet of the silencer 801, being fastened to the floor of the silencer 801 with rivets, sheet metal screws, tack-welds or other similar fastening systems.

In FIG. 8 the silencer 801 is shown connected to a fan coil assembly 811, which includes coils 813 and a drip pan 809 to collect condensate from the coils 813. The leading edge of the condensate diverter 803 may protrude from the front of the silencer 801 as shown in both FIG. 8 and FIG. 9 so that condensation dripping down from the condensate diverter 803 is diverted back to the drain slots in the water coil, to the existing drip pan 809. Alternatively, one could design the condensate diverter 803 to be entirely enclosed by the silencer 801 and provide a separate drip pan below the condensate diverter 803.

Exemplary dimensions for this silencer embodiment are shown in FIG. 9. Specifically, this embodiment is shown for a standard 36"L×21"W×9"H duct. The condensate diverter 803 is 8.344" long and is oriented at an angle of 35° to the lower panel of the casing 805. The lower baffle 807 and upper baffle 815 are parallel to one another and spaced apart by 3.5". The lower baffle 807 and upper baffle 815 are typically fabricated from perforated sheet metal or wire mesh, and are filled with sound-absorbing media. The type of media used, the density and binding agents will depend on the customer's specifications, building codes and the application and may include for example, matted or randomly arranged fibreglass or rockwool insulation. Such design parameters are known in the art.

The angle of the nosing and the length were optimized during design and testing to ensure that the condensation carryover would be effectively reduced without creating too much pressure drop. By increasing the length of the condensate diverter 803 one could effectively catch more condensate carryover but the length of the silencer would be increased. In the application of FIG. 9 it was necessary to keep the entire length less than 36" so sound testing was performed to optimize the design.

The diagonal orientation of the baffles 807, 815 provides a longer path for sound to travel along the baffle surfaces for a given a silencer length, resulting in greater sound reduction for a given silencer length. Increasing the gap between the baffles 807, 815 will result in lower losses, though it will result in less noise reduction. In the embodiment of FIG. 9 there is no line-of-sight path through the silencer when the leading edge of the lower baffle 807 is higher than the trailing edge of the upper baffle 815. Increasing the degree of overlap between the leading edge of the lower baffle 807 and the trailing edge of the upper baffle 815 when viewed from the inlet of the silencer will also increase the degree of noise reduction.

In this particular embodiment, integrating the silencer baffles 807, 815 and condensate diverter 803 allowed the combined unit to be reduced in length by 8". Reducing the length saves material, and also allows a silencer and condensate diverter to be installed in a tighter location. If space constraints forced one to go without a condensate diverter then downstream components could deteriorate due to rust and mold, and air quality would suffer.

Integrating the non-line-of-sight concept with the flat, condensate diverter nosing, effectively reduced the noise levels as well as reducing the amount of condensate carryover. Sound power levels of fan coil units were reduced as was condensate carryover, without reducing flow performance.

Silencers for fan coil units are available on the market but they do not offer integral condensate diverting sections. There are condensate diverting sections which are occasionally used in the industry but these are only available separate from the silencer. Typically, the trailing edge of commercially available condensate diverting sections do not line up at all with the leading edge of commercial silencers, so there is a great deal of turbulence and resulting air flow losses. Even if the two components did mate effectively, this would result in a longer component than the integral design of the invention, and it would not provide an optimized solution. That is, the integral design can be tested in a lab and optimized for design parameters. In contrast, combining separate silencer and condensate diverter sections that have been optimized independently will not yield the same performance.

While this invention has been described with reference to the structures and processed disclosed, it is to be understood that variations and modifications can be affected within the spirit and scope of the invention as described herein and as described in the appended claims.

What is claimed is:

1. A silencer comprising:

a casing having an inlet and an outlet;

a condensate deflector plate positioned at the inlet to said casing;

at least one baffle being operable to attenuate noise in a gas flowing through said silencer;

an air pathway through said silencer, defined by positions of said condensate deflector plate and said at least one baffle within said casing, the air pathway being angled or curved to substantially minimize the line-of-sight pathway from said inlet to said outlet.

2. The silencer of claim 1 wherein said condensate deflector plate has a leading edge at the inlet to said casing and a trailing edge fixed to a leading edge of one of said at least one baffles, the trailing edge of said one of said at least one baffles being fixed to the outlet of said casing.

3. The silencer of claim 2 comprising two baffles.

4. The silencer of claim 3 wherein said two baffles are straight, spaced-apart and are substantially parallel to one another.

5. The silencer of claim 3 wherein said two baffles define a uniform cross-section along the length of said baffles, for said air pathway.

6. The silencer of claim 4 wherein said two baffles are disposed within said casing in a diagonal orientation with respect to the top and bottom sides of said casing.

7. The silencer of claim 6 wherein said baffles comprise sound-absorbing media and perforated metal sheet.

8. The silencer of claim 1 wherein said casing is five feet or less in length.

9. The silencer of claim 1 wherein said condensate deflector plate comprises a substantially flat, rigid material.

10. The silencer of claim 1 wherein the leading edge of said condensate deflector plate is oriented to project beyond the leading edge of said casing, whereby condensation is directed to a drip pan outside said casing.

11. The silencer of claim 1 further comprising a drip pan to catch condensation from said condensate deflector plate.

12. The silencer of claim 6 wherein the leading edge of the lower baffle is higher than the trailing edge of the upper baffle.

13. A fan coil unit comprising:

a centrifugal fan;

a housing comprising a cutoff plate and a blower outlet and containing said centrifugal fan;

a first casing comprising a plenum and said housing, said first casing containing an inlet and an outlet;

a second casing comprising a silencing portion and containing at least one baffle, said second casing containing an inlet and an outlet;

wherein said blower outlet is connected to the outlet of said first casing;

wherein the outlet of said first casing is directly coupled to the inlet of said second casing;

wherein said silencing portion comprises:

a condensate deflector plate positioned at the inlet;

at least one baffle being operable to attenuate noise in a gas flowing through said silencer;

an air pathway through said silencer, defined by positions of said condensate deflector plate and said at least one baffle within said casing, the air pathway being angled or curved to substantially minimize the line-of-sight pathway from said inlet to said outlet.

14. The fan coil unit of claim 13 wherein said condensate deflector plate has a leading edge at the inlet to said second casing and a trailing edge fixed to a leading edge of one of said at least one baffles, the trailing edge of said one of said at least one baffles being fixed to the outlet of said second casing.

15. The fan coil unit of claim 14 comprising two baffles.

16. The fan coil unit of claim 15 wherein said two baffles are straight, spaced-apart and are substantially parallel to one another.

17. The fan coil unit of claim 15 wherein said two baffles define a uniform cross-section for said air pathway.

18. The fan coil unit of claim 16 wherein said two baffles are disposed within said second casing in a diagonal orientation with respect to the top and bottom sides of said second casing.

19. The fan coil unit of claim 18 wherein said baffles comprise sound-absorbing insulation and perforated metal sheet.

20. The fan coil unit of claim 19 wherein the leading edge of the lower baffle is higher than the trailing edge of the upper baffle.

* * * * *